United States Patent [19]

Ritt et al.

[11] Patent Number: 5,028,501

[45] Date of Patent: Jul. 2, 1991

[54] METHOD OF MANUFACTURING A LUMINESCENT SCREEN ASSEMBLY USING A DRY-POWDERED FILMING MATERIAL

[75] Inventors: Peter M. Ritt, East Petersburg; Harry R. Stork, Adamstown Borough, both of Pa.

[73] Assignee: RCA Licensing Corp., Princeton, N.J.

[21] Appl. No.: 365,877

[22] Filed: Jun. 14, 1989

[51] Int. Cl.[5] ..... G03C 5/00

[52] U.S. Cl. ..... 430/23; 430/28; 430/29

[58] Field of Search ..... 430/23, 28, 29, 132; 427/68, 335

[56] References Cited

U.S. PATENT DOCUMENTS

| | | | |
|---|---|---|---|
| 2,625,734 | 1/1953 | Law | 29/25.13 |
| 2,644,770 | 7/1953 | Sadowsky | 117/33.5 |
| 2,865,784 | 12/1958 | Saulnier | 117/33.5 |
| 3,140,174 | 7/1964 | Clark | 430/132 |
| 3,475,169 | 10/1969 | Lange | 96/1 |
| 3,558,310 | 1/1971 | Mayaud | 96/36.1 |
| 3,582,389 | 6/1971 | Saulnier | 117/33.5 |
| 3,582,390 | 6/1971 | Saulnier | 117/35 |
| 3,839,068 | 10/1974 | Miura | 117/335 C |
| 4,049,452 | 9/1977 | Nekut | 96/36.1 |
| 4,284,662 | 8/1981 | Matsuzaki et al. | 427/68 |
| 4,448,866 | 5/1984 | Olieslagers et al. | 430/24 |
| 4,620,133 | 10/1986 | Morrell et al. | 315/15 |
| 4,917,978 | 4/1990 | Ritt et al. | 430/29 |

*Primary Examiner*—John Goodrow

*Attorney, Agent, or Firm*—Joseph S. Tripoli; Dennis H. Irlbeck; Vincent J. Coughlin, Jr.

[57] ABSTRACT

In accordance with the present invention, a method of manufacturing a luminescent screen assembly on a substrate of a CRT includes the steps of providing a coating of a non-luminescent screen structure material in a predetermined pattern on the substrate and depositing a plurality of color-emitting screen structure materials on the substrate. The color-emitting screen structure materials are surrounded by the non-luminescent material. An electrostatically-charged dry-powdered resin is deposited onto the aforementioned color-emitting and non-luminescent screen structure materials and fused to form a substantially continuous film.

15 Claims, 2 Drawing Sheets

DEPOSIT
CHARGE
EXPOSE
DEVELOP
D.C. VOLTS
PHOSPHORS OR BLACK MATRIX
POWDERED FILMING RESIN
FILM
FUSE

METHOD OF MANUFACTURING A LUMINESCENT SCREEN ASSEMBLY USING A DRY-POWDERED FILMING MATERIAL

The present invention relates to a method of manufacturing a luminescent screen assembly, and more particularly to electrophotographically manufacturing a screen assembly for a color cathode-ray tube (CRT) using triboelectrically charged, dry-powdered surface-treated screen structure and filming materials.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multi-apertured sheet of metal precisely disposed between the screen and the beam-producing means. The apertured metal sheet shadows the screen, and the differences in convergence angles permit the transmitted portions of each beam to selectively excite phosphor elements of the desired emission color. A matrix of light-absorptive material surrounds the phosphor elements.

U.S. Pat. No. 3,475,169, issued to H. G. Lange on Oct. 28, 1969, discloses a process for electrophotographically screening color cathode-ray tubes. The inner surface of the faceplate of the CRT is coated with a volatilizable conductive material and then overcoated with a layer of volatilizable photoconductive material. The photoconductive layer is then uniformly charged, selectively exposed with light through the shadow mask to establish a latent charge image, and developed using a high molecular weight carrier liquid. The carrier liquid bears, in suspension, a quantity of phosphor particles of a given emissive color that are selectively deposited onto suitably charged areas of the photoconductive layer, to develop the latent image. The charging, exposing and deposition process is repeated for each of the three color-emissive phosphors of the screen. An improvement in electrophotographic screening is described in U.S. Pat. No. 4,448,866, issued to H. G. Olieslagers et al. on May 15, 1984. In that patent, phosphor particle adhesion is said to be increased by uniformly exposing, with light, the portions of the photoconductive layer lying between the deposited pattern of phosphor particles after each deposition step, so as to reduce or discharge any residual charge and to permit a more uniform recharging of the photoconductor for subsequent depositions.

The two above cited patents disclose an electrophotographic process that is, in essence, a wet process. A drawback of the wet process is that it may not be capable of meeting the higher resolution demands of the next generation of entertainment devices and the even higher resolution requirements for monitors, work stations and applications requiring color alpha-numeric text. Additionally, the wet process (including matrix processing) requires a large number of major processing steps, necessitates extensive plumbing and the use of clean water, requires phosphor salvage and reclamation, and utilizes large quantities of electrical energy for exposing and drying the phosphor materials.

U.S. Pat. Nos. 4,921,727 and 4,921,767, issued May 1, 1990 to P. Datta et al., and U.S. patent application Ser. No. 287,356; 287,358 and 287,355, by P. Datta et al., filed on Dec. 21, 1988, describe an improved process for manufacturing CRT screen assemblies using triboelectrically charged dry-powdered screen structure materials, and surface-treated phosphor particles having a coupling agent thereon to control the triboelectric charging characteristics of the phosphor particles. During the manufacturing process, the surface-treated screen structure materials are electrostatically attracted to the photoconductive layer on the faceplate, and the attractive force is a function of the magnitude of the triboelectric charge on the screen structure materials. Thermal bonding has been utilized to affix the relatively loosely bonded surface-treated materials to the photoconductive layer; however, thermal bonding occasionally causes cracks in the photoconductive layer, which becomes detached during a subsequent filming step in the manufacturing process. Additionally, it is desirable to eliminate the fusable thermoplastic phosphor coating that is used with some of the above-identified triboelectrical processes since such coatings add additional organic materials which can negatively affect phosphor emission efficiency. It has been determined that an alternative method of dry filming is thus desirable to increase phosphor efficiency, screen uniformity and adherency, while preventing the loss of screen assemblies during the manufacturing process due to cracked or detached photoconductive layers.

SUMMARY OF THE INVENTION

In accordance with the present invention, a method of manufacturing a luminescent screen assembly on a substrate of a CRT includes the steps of providing a coating of a non-luminescent screen structure material in a predetermined pattern on the substrate and depositing a plurality of color-emitting screen structure materials on the substrate. The color-emitting screen structure materials are surrounded by the non-luminescent material. An electrostatically-charged dry-powdered resin is deposited onto the color-emitting and non-luminescent screen structure materials and fused to form a substantially continuous film.

Figure 1:
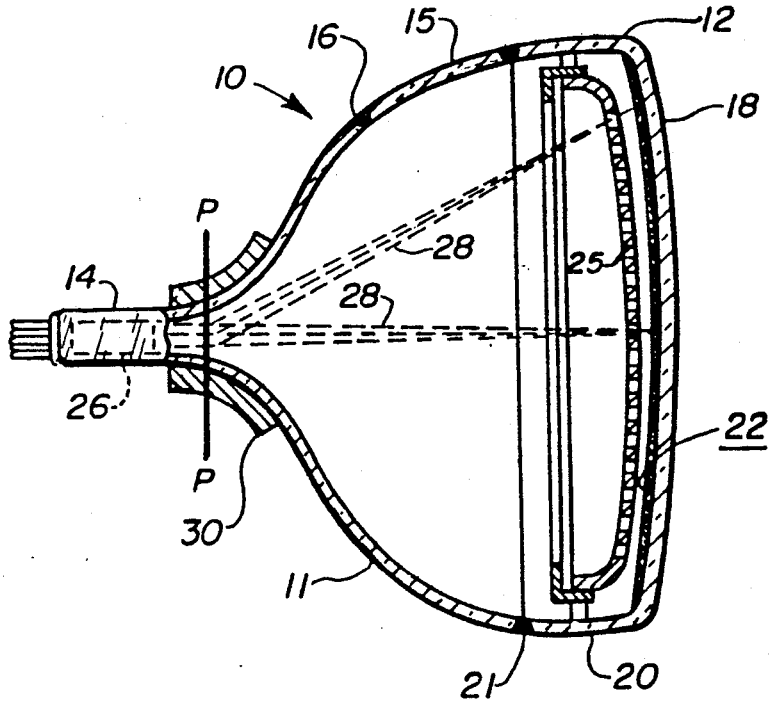
FIG. 1 is a plan view, partially in axial section, of a color cathode-ray tube made according to the present invention.

FIGS. *3a–3g* show selected steps in the manufacturing of the tube shown in FIG. 1.

DETAILED DESCRIPTION OF THE PREFERRED EMBODIMENT

Figure 2:
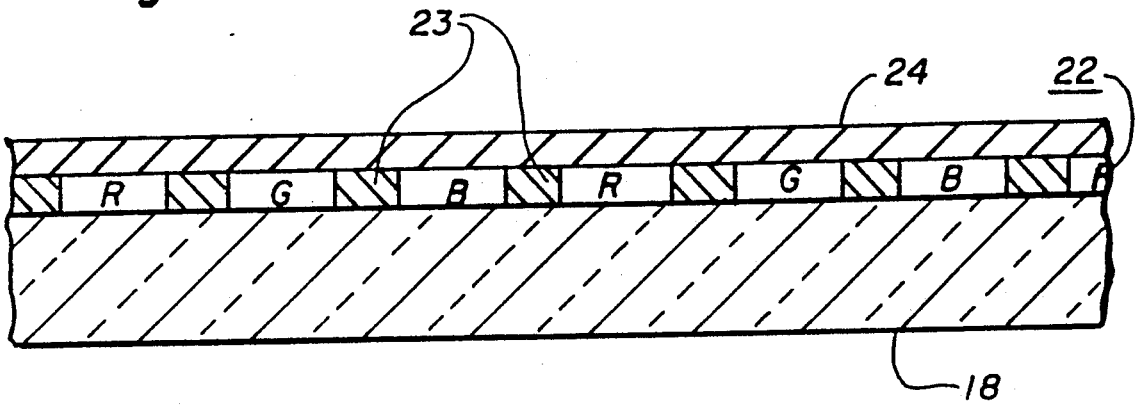
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position of the embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22 and the overlying aluminum layer 24 comprise a screen assembly.

With respect again to FIG. 1, a multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures in the mask 25, to the screen 22. The gun 26 may be, for example, a bi-potential electron gun of the type described in U.S. Pat. No. 4,620,133, issued to Morrell et al., on Oct. 28, 1986, or any other suitable gun.

The tube 10 is designed to be used with an external magnetic deflection yoke, such as yoke 30 located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvatures of the deflection beam paths in the deflection zone are not shown.

The screen 22 is manufactured by a novel electrophotographic process that is schematically represented in FIGS. 3*a* through 3*g*. Initially, the panel 12 is washed with a caustic solution, rinsed with water, etched with buffered hydrofluoric acid and rinsed once again with water, as is known in the art. The inner surface of the viewing faceplate 18 is then coated with a layer 32 of electrically conductive material which provides an electrode for an overlying photoconductive layer 34. The photoconductive layer 34 comprises a volatilizable organic polymeric material, a suitable photoconductive dye sensitive to visible light and a solvent. The composition and method of forming the conductive layer 32 and the photoconductive layer 34 are described in the above-identified U.S. Pat. No. 4,921,767.

Figures 3A, 3B, 3C, 3D, 3E, 3F, 3G:
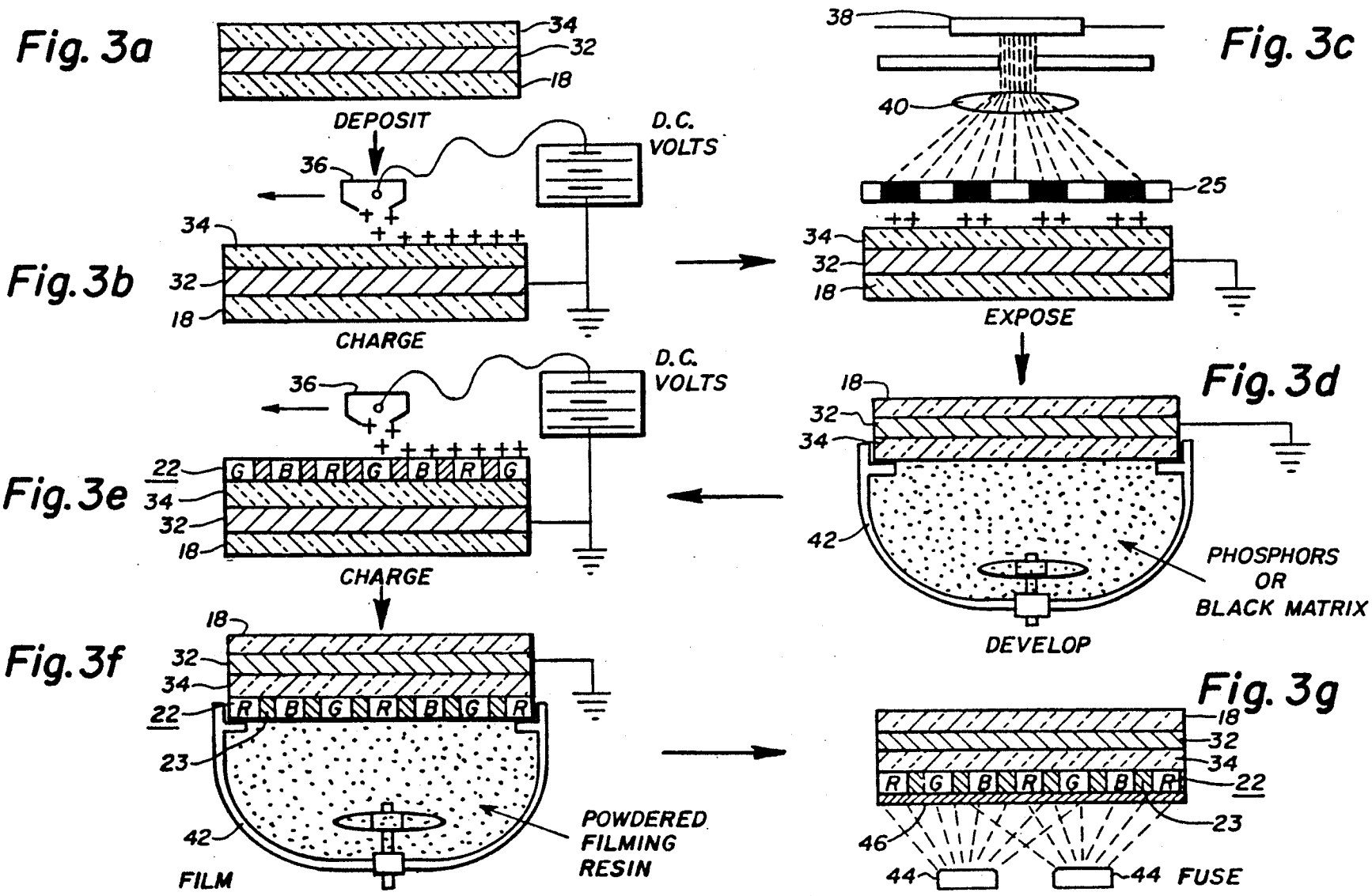

The photoconductive layer 34 overlying the conductive layer 32 is charged in a dark environment by a conventional positive corona discharge apparatus 36, schematically shown in FIG. 3*b*, which moves across the layer 34 and charges it within the range of +200 to +700 volts, +200 to +400 volts being preferred. The shadow mask 25 is inserted in the panel 12, and the positively-charged photoconductor is exposed, through the shadow mask, to the light from a xenon flash lamp 38 disposed within a conventional three-in-one lighthouse (represented by lens 40 of FIG. 3*c*). After each exposure, the lamp is moved to a different position, to duplicate the incident angle of the electron beams from the electron gun. Three exposures are required, from three different lamp positions, to discharge the areas of the photoconductor where the light-emitting phosphors subsequently will be deposited to form the screen. After the exposure step, the shadow mask 25 is removed from the panel 12, and the panel is moved to a first developer 42 (FIG. 3*d*). The first developer contains suitably prepared dry-powdered particles of a light-absorptive black matrix screen structure material and surface-treated insulative carrier beads (not shown), which have a diameter of about 100 to 300 microns and which impart a triboelectrical charge to the particles of black matrix material, as described herein.

Suitable black matrix materials generally contain black pigments which are stable at a tube processing temperature of 450° C. Black pigments suitable for use in making matrix materials include: iron manganese oxide, iron cobalt oxide, zinc iron sulfide and insulating carbon black. The black matrix material is prepared by melt-blending the pigment, a polymer and a suitable charge control agent which controls the magnitude of the triboelectric charge imparted to the matrix material. The material is ground to an average particle size of about 5 microns.

The black matrix material and the surface-treated carrier beads are mixed in the developer 42, using about 1 to 2 percent by weight of black matrix material. The material and beads are mixed so that the finely divided matrix particles contact and are charged, e.g., negatively, by the surface-treated carrier beads. The negatively-charged matrix particles are expelled from the developer 42 and attracted to the positively-charged, unexposed area of the photoconductive layer 34, to directly develop that area.

The photoconductive layer 34, containing the matrix 23, is uniformly recharged to a positive potential of about 200 to 400 volts, for the application cf the first of three triboelectrically charged, dry-powdered, color-emitting phosphor screen structure materials. While non-surface-treated phosphor materials are preferred for their higher emission efficiency, surface-treated phosphor materials, described in the above-identified U.S. Pat. No. 4,921,727 and U.S. patent application Ser. No. 287,358, may be utilized. The shadow mask 25 is reinserted into the panel 12 and selected areas of the photoconductive layer 34, corresponding to the locations where green-emitting phosphor material will be deposited, are exposed to visible light from a first location within the lighthouse, to selectively discharge the exposed areas. The first light location approximates the convergence angle of the green phosphor-impinging electron beam. The shadow mask 25 is removed from the panel 12, and the panel is moved to a second developer 42. The second developer contains triboelectrically charged, dry-powdered particles of green-emitting phosphor screen structure material, and surface-treated carrier beads. One thousand grams of surface-treated carrier beads are combined with about 15 to 25 grams of phosphor particles in the second developer 42. The carrier beads are treated with a fluorosilane coupling agent to impart a, e.g. positive, charge on the phosphor particles. To charge the phosphor particles negatively, an aminosilane coupling agent is used on the carrier beads. The positively-charged green-emitting phosphor particles are expelled from the developer, repelled by the positively-charged areas of the photoconductive layer 34 and matrix 23, and deposited onto the discharged, light exposed areas of the photoconductive layer, in a process known as reversal developing.

The process of charging, exposing and developing is repeated for the dry-powdered, blue- and red-emitting, phosphor particles of screen structure material. The exposure to visible light, to selectively discharge the positively-charged areas of the photoconductive layer 34, is made from a second and then from a third position within the lighthouse, to approximate the convergence angles of the blue phosphor- and red phosphor-impinging electron beams, respectively. The triboelectrically positively-charged, dry-powdered phosphor particles are mixed with the surface-treated carrier beads in the ratio described above and expelled from a third and then a fourth developer 42, repelled by the positively-charged areas of the previously deposited screen structure materials, and deposited on the discharged areas of the photoconductive layer 34, to provide the blue and red-emitting phosphor elements, respectively.

The screen structure materials, comprising the surface-treated black matrix material and the green-, blue-, and red-emitting phosphor particles are electrostatically attached, or bonded, to the photoconductive layer 34. The adherence of the screen structure materials can be increased by directly depositing thereon an electrostatically charged dry-powdered filming resin from a fifth developer 42 (FIG. 3*f*). The conductive layer 32 is grounded during the deposition of the resin. A substantially uniform positive potential of about 200 to 400 volts may be applied to the photoconductive layer and to the overlying screen structure materials using the discharge apparatus 36 (FIG. 3*e*), prior to the filming step, to provide an attractive potential and to assure a uniform deposition of the resin which, in this instance, would be charged negatively. The developer may be, for example, a Ransburg gun which charges the resin particles by corona discharge. The resin is an organic material with a low glass transition temperature/melt flow index of less than about 120° C., and with a pyrolyzation temperature of less than about 400° C. The resin is water insoluble, preferably has an irregular particle shape for better charge distribution, and has a particle size of less than about 50 micron. The preferred material is n-butyl methacrylate; however, other acrylic resins, methyl methacrylates and polyethylene waxes have been successfully utilized. Between about 1 and 10 grams, and typically about 2 grams, of powdered filming resin is deposited onto the screen surface 22 of the faceplate 18. The faceplate is then heated to a temperature of between 100° to 120° C. for about 1 to 5 minutes using a heat source such as heaters 44 (FIG. 3*g*), to melt the resin and to form a substantially continuous film 46 which bonds the screen structure materials to the faceplate 18. By way of example, 3 minutes are required to melt 2 grams of resin using a plurality of longitudinally extending radiant heaters, such as CH-40 heaters available from Corning Glass Works, Corning, N.Y. The film 46 is water insoluble and acts as a protective barrier if a subsequent wet-filming step is required to provide additional film thickness or uniformity. If sufficient dry-filming resin is utilized, the subsequent wet-filming step is unnecessary. An aqueous 2 to 4 percent, by weight, solution of boric acid or ammonium oxalate is oversprayed onto the film 46 to form a ventilation-promoting coating (not shown). Then the panel is aluminized, as is known in the art, and baked at a temperature of about 425°0 C. for about 30 to 60 minutes or until the volatilizable organic constituents are driven from the screen assembly. The ventilation-promoting coating begins to bake-out at about 185° C. and produces small pin holes in the aluminium layer which facilitate removal of the organic constituents without blistering the aluminum layer.

The dry-powdered resins, with the exception of the polyethylene waxes, also may be formed or fused into the film 46, by exposing the electrostatically deposited resins to a suitable solvent such as acetone (which is preferred), chlorobenzene, toluene, methyl ethyl ketone (MEK), or methyl isobutyl ketone (MIBK). The solvent exposure (not shown) can be achieved either by fogging, vapor deposition, or by direct spray means. The solvent method provides a more uniform film layer 46 than does the heating method disclosed above; however, special handling and venting are required if solvent fusing of the film is utilized. Of the three solvent exposure methods for fusing the film, vapor deposition is the slowest but gentlest and least likely to disturb the filming resin and underlying screen structure materials. The direct spray method of solvent exposure is the fastest method and does not require complex equipment; however, it tends to displace the underlying screen structure materials. Fogging is the preferred solvent exposure method, because it optimizes the process by combining the speed of the spray with the gentleness of the vapor.

While the invention has been described in terms of filming a viewing screen made using dry-powdered screen structure materials, the dry-powdered filming resin of the present invention may be used in conjunction with the conventional wet photolithographic screening process.

In the wet process, a light absorbing matrix comprising a suitable dark pigment of elemental carbon is formed on the inner surface of the faceplate, by the method described in U.S. Pat. No. 3,558,310, issued to E. Mayaud on Jan. 26, 1971, as further refined in U.S. Pat. No. 4,049,452, issued to E. Mayaud Nekut on Sept. 20, 1977. Briefly, the inner surface of the faceplate is coated with a film of a clear polymeric material whose solubility is altered when exposed to radiant energy. A shadow mask is positioned within the faceplate, above the film, and a lighthouse projects light through the mask. The irradiated regions of the film harden; that is, they become insoluble in water. The exposure through the mask is repeated three times, each time with the light incident at a slightly different angle so that the rays harden the film in groups of three, as is known in the art. After the exposure, the shadow mask is removed from the faceplate, and the exposed coating is subjected to flushing with water to remove the soluble, unexposed, portion of the film and to expose the bare faceplate while retaining the insolubilized regions in place. Then, the developed film is overcoated with a layer containing particles of screen structure material, such as the aforementioned elemental carbon in a suitable composition. The overcoating is dried and cooled. After cooling, the overcoating is well adhered to the polymeric regions and to the bare faceplate surface. Finally, the retained polymeric regions are removed together with the overlying overcoating, while retaining that portion of the overcoating adhered to the bare faceplate surface which now comprises the matrix.

The phosphor elements are formed in the now bare area of the faceplate, previously occupied by the overcoated insolubilized polymeric regions, by the wet photolithographic process described in U.S. Pat. No. 2,625,734, issued to H. B. Law on Jan. 20, 1953.

After the matrix and phosphor elements are formed by the conventional process described in U.S. Pat. No. 2,625,734, the filming is done by the novel dry-powdered resin process. The matrix, formed of carbon, (a conductive material) is grounded, and the electrostatically negatively-charged, dry-powdered filming resin is deposited on the screen structure materials. The matrix is grounded to prevent a negative charge-buildup and subsequent repulsion of the dry-powdered filming resin that would otherwise occur. The filming resin, deposited as described above, is fused to form a substantially continuous, smooth film identical to film 46 described above. The film is oversprayed with the above-described ventilation-promoting coating, aluminized ant baked, as is known in the art, to form the screen assembly.

What is claimed is:

1. In a method of manufacturing a luminescent screen assembly on a substrate of a color CRT comprising the steps of:

a) providing a layer of a non-luminescent screen-structure material in a predetermined pattern on said substrate; and b) depositing a plurality of color-emitting screen-structure materials on said substrate, said color-emitting materials being surrounded by said non-luminescent material; wherein the improvement comprises the steps of:

depositing an electrostatically-charged dry-powdered resin onto said non-luminescent and said color-emitting screen structure materials; and fusing said resin to form a substantially continuous film layer.

2. In a method of electrophotographically manufacturing a luminescent screen assembly o; a substrate of a color CRT comprising the steps of:

a) coating said surface of said substrate with a volatilizable conductive layer;

b) overcoating said conductive layer with a volatilizable photoconductive layer including a dye sensitive to visible light;

c) establishing a substantially uniform electrostatic charge on said photoconductive layer;

d) exposing selected areas of said photoconductive layer to visible light to affect the charge thereon;

e) developing selected areas of said photoconductive layer with a triboelectrically charged, dry-powdered, first color-emitting phosphor material; and f) sequentially repeating steps c, d and e for triboelectrically charged, dry-powdered, second and third color-emitting phosphor materials to form a luminescent screen comprising picture elements of triads of color-emitting phosphor materials;

wherein the improvement comprises the steps of:

establishing an electrostatic charge on said photoconductive layer and the overlying phosphor materials;

depositing an electrostatically charged dry-powdered resin onto said phosphor materials; and fusing said resin to form a substantially continuous film layer.

3. The method of claim 2, wherein said dry-powdered acrylic resin is selected from the group consisting of n-butyl methacrylate, methyl methacrylate and polyethylene waxes.

4. The method of claim 3, wherein said resin is fused by heating said resin to a temperature of less than about 120° C.

5. The method of claim 3 wherein said n-butyl methacrylate and said methyl methacrylate are fused by contacting said resin with a suitable solvent.

6. The method of claim 5 wherein contacting said resin includes fogging, vapor soaking and spraying said resin with said solvent.

7. The method of claim 6 wherein said solvent is selected from the group consisting of acetone, chlorobenzene, toluene, MEK, and MIBK.

8. The method of claim 2 further including the steps of:

providing said us film layer with a ventilation-promoting coating;

aluminizing said screen; and baking said screen at an elevated temperature to remove the volatilizable constituents therefrom to form said luminescent screen assembly.

9. In a method of electrophotographically manufacturing a luminescent screen assembly on an interior surface of a faceplate panel for a color CRT comprising the steps of:

a) coating said surface of said panel with a volatilizable conductive layer;

b) overcoating said conductive layer with a volatilizable photoconductive layer including a dye sensitive to visible light;

c) establishing a substantially uniform electrostatic charge on said photoconductive layer;

d) exposing, through a mask, selected areas of said photoconductive layer to visible light from a xenon lamp to affect the charge on said photoconductive layer;

e) directly developing the unexposed areas of the photoconductive layer with a triboelectrically charged, dry-powdered, surface-treated, light-absorptive screen structure material, the charge on said screen structure material being of opposite polarity to the charge on the unexposed areas of the photoconductive layer;

f) reestablishing a substantially uniform electrostatic charge on said photoconductive layer and on said screen structure material;

g) exposing, through said mask, first portions of said selected areas of said photoconductive layer to visible light from said lamp to affect the charge on said photoconductive layer;

h) reversal developing of the first portions of said selected areas of said photoconductive layer with a triboelectrically charged, dry-powdered, first color-emitting phosphor screen structure material having a charge of the same polarity as that on the unexposed areas of said photoconductive layer and on said light-absorptive screen structure material to repel said first color-emitting phosphor therefrom;

i) sequentially repeating steps f, g and h for second and third portions of said selected areas of said photoconductive layer using triboelectrically charged, dry-powdered, second and third color-emitting phosphor screen structure materials, thereby forming a luminescent screen comprising picture elements of triads of color-emitting phosphors;

wherein the improvement comprises increasing the adherence of said surface-treated screen structure materials to said photoconductive layer by establishing a substantially uniform electrostatic charge on said photoconductive layer and the overlying screen structure materials, depositing an electrostatically charged dry-powdered resin onto said screen structure materials; and fusing said resin to form a substantially continuous water insoluble film layer.

10. The method of claim 9, wherein said dry-powdered acrylic resin is selected from the group consisting of n-butyl methacrylate, methyl methacrylate and polyethylene waxes.

11. The method of claim 10, wherein said resin is fused by heating said resin to a temperature of less than about 120°0 C.

12. The method of claim 10 wherein said n-butyl methacrylate and said methyl methacrylate are fused by contacting said resin with a suitable solvent.

13. The method of claim 12 wherein contacting said resin includes fogging, vapor soaking and spraying said resin with said solvent.

14. The method of claim 13 wherein said solvent is selected from the group consisting of acetone, chlorobenzene, toluene, MEK, and MIBK.

15. The method of claim 9 further including the steps of:

providing said continuous film layer with a ventilation-promoting coating;

aluminizing said screen; and baking said screen at an elevated temperature to remove the volatilizable constituents therefrom to form said luminescent screen assembly.

* * * * *

UNITED STATES PATENT AND TRADEMARK OFFICE
CERTIFICATE OF CORRECTION

PATENT NO. : 5,028,501

DATED : July 2, 1991

INVENTOR(S) : Peter Michael Ritt et al.

It is certified that error appears in the above-identified patent and that said Letters Patent is hereby corrected as shown below:

Col. 2, line 1, delete
"287,356;" and "287,355,"

Col. 4, line 35, change
"cf" to --of--.

Col. 7, line 35, change
"o;" to --on--.

Col. 8, line 12, change
"us" to --continuous--.

Signed and Sealed this

Thirteenth Day of October, 1992

*Attest:*

DOUGLAS B. COMER

*Attesting Officer*

*Acting Commissioner of Patents and Trademarks*